US011111822B2

(12) United States Patent
Tableau et al.

(10) Patent No.: US 11,111,822 B2
(45) Date of Patent: Sep. 7, 2021

(54) TURBINE RING ASSEMBLY

(71) Applicant: SAFRAN AIRCRAFT ENGINES, Paris (FR)

(72) Inventors: Nicolas Paul Tableau, Moissy-Cramayel (FR); Sebastien Serge Francis Congratel, Moissy-Cramayel (FR); Clement Jean Pierre Duffau, Moissy-Cramayel (FR); Hubert Jean-Yves Illand, Moissy-Cramayel (FR); Lucien Henri Jacques Quennehen, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/494,062

(22) PCT Filed: Mar. 13, 2018

(86) PCT No.: PCT/FR2018/050588
§ 371 (c)(1),
(2) Date: Sep. 13, 2019

(87) PCT Pub. No.: WO2018/172654
PCT Pub. Date: Sep. 27, 2018

(65) Prior Publication Data

US 2020/0131938 A1 Apr. 30, 2020

(30) Foreign Application Priority Data

Mar. 16, 2017 (FR) ..... 1752149

(51) Int. Cl.
*F01D 25/24* (2006.01)
*F01D 11/08* (2006.01)
(Continued)

(52) U.S. Cl.
CPC ..... *F01D 25/246* (2013.01); *F01D 11/08* (2013.01); *F01D 5/282* (2013.01); *F01D 5/284* (2013.01);
(Continued)

(58) Field of Classification Search
CPC ..... F01D 25/246; F01D 11/08; F01D 9/04; F01D 11/24; F01D 25/28; F01D 11/005; F01D 5/282; F01D 5/284; F05D 2240/11
See application file for complete search history.

(56) References Cited

U.S. PATENT DOCUMENTS 4,596,116 A * 6/1986 Mandet ..... F01D 11/24 60/785
4,759,687 A 7/1988 Miraucourt et al.
(Continued)

FOREIGN PATENT DOCUMENTS

EP 0 243 274 A1 10/1987
EP 1 847 686 A1 10/2007
(Continued)

OTHER PUBLICATIONS

International Search Report dated Jun. 22, 2018 in PCT/FR2018/050588 filed Mar. 13, 2018.

*Primary Examiner* — Woody A Lee, Jr.
*Assistant Examiner* — Behnoush Haghighian
(74) *Attorney, Agent, or Firm* — Oblon, McClelland, Maier & Neustadt, L.L.P.

(57) ABSTRACT

A turbine ring assembly including ring sectors forming a turbine ring and a ring support structure, each ring sector having, along a section plane defined by an axial direction and a radial direction of the ring, a portion forming an annular base with, in the radial direction an inner face defining the inner face of the ring and an outer face from which a first and a second attachment tabs protrude, the
(Continued)

structure including a central shroud from which a first and a second radial clamps protrude between which the first and second attachment tabs of each ring sector are maintained. It includes a first and a second annular flanges removably fastened to the first radial clamp of the central shroud and separated from each other by a contact abutment.

10 Claims, 8 Drawing Sheets

(51) Int. Cl.
*F01D 5/28* (2006.01)
*F01D 9/04* (2006.01)

(52) U.S. Cl.
CPC ..... *F01D 9/04* (2013.01); *F05C 2253/04* (2013.01); *F05D 2240/11* (2013.01); *F05D 2300/6033* (2013.01)

(56) References Cited

U.S. PATENT DOCUMENTS 5,593,277 A * 1/1997 Proctor ..... F01D 11/18 415/115
6,877,952 B2 * 4/2005 Wilson ..... F01D 11/18 415/136
6,884,026 B2 * 4/2005 Glynn ..... F01D 11/08 415/113
7,494,317 B2 * 2/2009 Keller ..... F01D 11/025 415/136
9,322,415 B2 * 4/2016 Rioux ..... F04D 29/542
9,587,517 B2 * 3/2017 Vetters ..... F01D 11/08
9,863,265 B2 * 1/2018 Stapleton ..... F04D 29/321
9,874,104 B2 * 1/2018 Shapiro ..... F01D 25/246
9,945,256 B2 * 4/2018 Freeman ..... F01D 11/12
10,030,541 B2 * 7/2018 Vetters ..... F01D 25/246
10,145,252 B2 * 12/2018 Kirby ..... F01D 11/001
10,202,857 B2 * 2/2019 Simonds ..... F01D 11/003
10,301,960 B2 * 5/2019 Stapleton ..... F01D 9/042
10,655,501 B2 * 5/2020 Lepretre ..... F01D 25/246
2007/0231132 A1 10/2007 Durand et al.
2015/0369077 A1 12/2015 Klasing et al.
2016/0251982 A1 * 9/2016 Shapiro ..... F01D 25/246 415/134
2017/0016341 A1 * 1/2017 Stapleton ..... F01D 9/042

FOREIGN PATENT DOCUMENTS

GB 2 136 508 A 9/1984
WO WO 2014/123654 A1 8/2014

* cited by examiner

TURBINE RING ASSEMBLY

BACKGROUND OF THE INVENTION

The invention relates to a turbine ring assembly comprising a plurality of ring sectors made of ceramic-matrix composite material as well as a ring support structure.

The field of application of the invention is in particular that of the aeronautical gas turbine engines. The invention is however applicable to other turbomachines, for example industrial turbines.

In the case of entirely metallic turbine ring assemblies, it is necessary to cool all the elements of the assembly and particularly the turbine ring which is subjected to the hottest flows. This cooling has a significant impact on the engine performance since the cooling flow used is taken from the main flow of the engine. In addition, the use of metal for the turbine ring limits the possibilities to increase the temperature at the turbine, which would however allow improving the performance of the aeronautical engines.

In order to solve these problems, it has been envisaged to produce turbine ring sectors made of ceramic-matrix composite material (CMC) in order to overcome the implementation of a metal material.

CMC materials have good mechanical properties making them capable of forming structural elements and advantageously preserve these properties at high temperatures. The implementation of CMC materials has advantageously allowed reducing the cooling flow to be imposed during the operation and therefore increasing the performance of the turbomachines. In addition, the implementation of CMC materials advantageously allows decreasing the weight of the turbomachines and reducing the effect of hot expansion encountered with the metal parts.

However, the existing solutions proposed can implement an assembling of a CMC ring sector with metal attachment portions of a ring support structure, these attachment portions being subjected to the hot flow. Consequently, these metal attachment portions undergo hot expansions, which can lead to mechanical stressing of the CMC ring sectors and to an embrittlement thereof.

Furthermore, documents FR 2 540 939, GB 2 480 766, EP 1 350 927, US 2014/0271145, US 2012/082540 and FR 2 955 898 which disclose turbine ring assemblies, are known.

There is a need to improve existing turbine ring assemblies and their mounting, and in particular the existing turbine ring assemblies implementing a CMC material in order to reduce the intensity of the mechanical stresses to which the CMC ring sectors are subjected during the operation of the turbine.

OBJECT AND SUMMARY OF THE INVENTION

The invention aims at proposing a turbine ring assembly allowing to maintain each ring sector in a deterministic manner, that is to say, so as to control its position and prevent it from vibrating, on the one hand, while allowing the ring sector, and by extension the ring, to deform under the effects of temperature rises and pressure variations, and this in particular independently of the interface metal parts and, on the other hand, while improving the sealing between the off-flowpath sector and the flowpath sector and while simplifying the manipulations and reducing their number for the mounting of the ring assembly.

An object of the invention proposes a turbine ring assembly comprising a plurality of ring sectors forming a turbine ring and a ring support structure, each ring sector having, according to a section plane defined by an axial direction and a radial direction of the turbine ring, a portion forming an annular base with, in the radial direction of the turbine ring, an inner face defining the inner face of the turbine ring and an outer face from which a first and a second attachment tabs protrude, the ring support structure including a central shroud from which a first and a second radial clamps protrude between which the first and second attachment tabs of each ring sector are maintained.

According to a general characteristic of the object, the turbine ring assembly comprises a first annular flange and a second annular flange disposed upstream of the first annular flange with respect to the direction of an air flow intended to pass through the turbine ring assembly, the first and second annular flanges having respectively a first free end and a second end opposite to the first end, the first end of the first annular flange bearing against the first attachment tab, the first end of the second annular flange being spaced apart from the first end of the first annular flange in the axial direction, the second ends of the first and second annular flanges being removably fastened to the first radial clamp of the central shroud of the ring support structure, and the second end of the first flange and the second end of the second flange being separated by a contact abutment.

In a particular embodiment, the ring sectors may be made of ceramic-matrix composite material (CMC).

The second annular flange separated from the first annular flange at its free end allows providing the turbine ring assembly with an upstream flange dedicated to take up the force of the high-pressure distributor (DHP). The second annular flange upstream of the turbine ring and free from any contact with the ring is configured to transit the maximum axial force induced by the DHP directly into the ring support structure without passing through the ring which, when it is made of CMC, has a low mechanical permissible element.

Indeed, leaving a space between the first ends of the first and second annular flanges allows deflecting the force received by the second flange, upstream of the first annular flange which is in contact with the turbine ring, and transiting it directly toward the central shroud of the ring support structure via the second end of the second annular flange, without impacting the first annular flange and therefore without impacting the turbine ring. The first end of the first flange do not undergo a force, the turbine ring is thus preserved from this axial force.

The transit of the DHP force via the second annular flange can induce its tilting. This tilting can cause an uncontrolled contact between the low portions, that is to say the first ends, of the second annular flange and the first annular flange in contact with the turbine ring, which would have the consequence of transmitting directly the DHP force to the ring.

The contact abutment provided between the second ends of the first and second annular flanges allows avoiding the contact between the low portion of the second annular flange, disposed upstream of the first flange, and that of the first annular flange, following this tilting. The direct transit of the DHP force toward the ring is therefore avoided.

In addition, the removable nature of the annular flanges makes it possible to have axial access to the cavity of the turbine ring. This allows assembling the ring sectors together outside the ring support structure and then axially sliding the assembly thus assembled into the cavity of the ring support structure until bearing against the second radial clamp, before fastening the annular flange on the central shroud of the ring support structure.

During the operation of fastening the turbine ring on the support structure of the ring, it is possible to use a tool including a cylinder or a ring on which the ring sectors are pressed or sucked during their crown assembling.

The fact of having two annular flanges each in one piece, that is to say describing the entirety of a ring over 360°, allows, compared to sectored annular flanges, limiting the passage of the air flow between the off-flowpath sector and the flowpath sector, in so far as all the inter-sector leaks are eliminated, and therefore controlling the sealing.

The solution defined above for the ring assembly thus makes it possible to maintain each ring sector in a deterministic manner, that is to say to control its position and prevent it from starting to vibrate, while improving the sealing between the off-flowpath sector and the flowpath sector, while simplifying the manipulations and while reducing their number for the mounting of the ring assembly, and while allowing the ring to deform under the effect of temperature and pressure in particular independently of the interface metal parts.

According to a first aspect of the turbine ring assembly, the first annular flange may comprise the contact abutment.

According to a second aspect of the turbine ring assembly, the second annular flange may comprise the contact abutment.

According to a third aspect of the turbine ring assembly, the first flange may have a thickness in the axial direction smaller than the thickness in the axial direction of the second flange.

The thinness of the second end of the first annular flange provides flexibility to the upstream portion of the support structure intended to be in contact with the ring.

The second annular clamp, downstream of the first annular clamp, ensures, due to its increased thickness, a greater rigidity to the downstream portion of the ring support structure.

According to a fourth aspect of the turbine ring assembly, the central shroud of the ring support structure has a variable radius in the axial direction, the radius of the central shroud decreasing in the direction of the air flow intended to pass through the turbine ring assembly, that is to say in the direction from the first radial clamp to the second radial clamp.

More particularly, the central shroud of the ring support structure has a first radial portion facing the first attachment tab of the turbine ring, and a second radial portion downstream of the first radial portion relative to the direction of said air flow intended to pass through the turbine ring assembly and facing the second attachment tab of the turbine ring, the second radial portion having a radius of curvature smaller than the radius of curvature of the first radial portion.

According to a fifth aspect of the turbine ring assembly, the second radial clamp of the ring support structure has a first free end and a second end secured to the central shroud of the ring support structure, the first end of the second radial clamp being in contact with the second attachment tab of the turbine ring and having a thickness in the axial direction greater than the thickness of the first end of the first annular flange.

The control of the rigidity at the axial contacts of the ring support structure with the ring ensures maintaining the sealing in all circumstances, without inducing too high axial forces on the ring. The thin section of the second downstream annular clamp of the ring support structure allows ensuring a flexibility of the downstream portion of the ring support structure vis-à-vis its upstream portion formed by the first annular clamp and the first and second annular flanges, due to the large thickness of the first annular clamp.

According to a sixth aspect of the turbine ring assembly, the ring sector may have an inverted Greek letter section pi ($\pi$) along the section plane defined by the axial direction and the radial direction, and the assembly may comprise, for each ring sector, at least three pins to radially hold the ring sector in position, the first and second attachment tabs of each ring sector each comprising a first end secured to the outer face of the annular base, a second free end, at least three lugs for receiving said at least three pins, at least two lugs protruding from the second end of one of the first or second attachment tabs in the radial direction of the turbine ring and at least one lug protruding from the second end of the other attachment tab in the radial direction of the turbine ring, each receiving lug including an orifice for receiving one of the pins.

According to a seventh aspect of the turbine ring assembly, the ring sector may have a section with an elongated K-shape along the section plane defined by the axial direction and the radial direction, the first and a second attachment tabs having an S-shape.

According to an eighth aspect of the turbine ring assembly, the ring sector may have, on at least one radial range of the ring sector, an O-section along the section plane defined by the axial direction and the radial direction, the first and second attachment tabs each having a first end secured to the outer face and a second free end, and each ring sector comprising a third and a fourth attachment tabs each extending, in the axial direction of the turbine ring, between a second end of the first attachment tab and a second end of the second attachment tab, each ring sector being fastened to the ring support structure by a fastening screw including a screw head bearing against the ring support structure and a thread cooperating with a tapping formed in a fastening plate, the fastening plate cooperating with the third and fourth attachment tabs. The ring sector further comprises radial pins extending between the central shroud and the third and fourth attachment tabs.

Another object of the invention proposes a turbomachine comprising a turbine ring assembly as defined above.

SHORT DESCRIPTION OF THE DRAWINGS

The invention will be better understood upon reading the following, by way of indication but without limitation, with reference to the appended drawings in which.

DETAILED DESCRIPTION OF EMBODIMENTS

Figure 1:
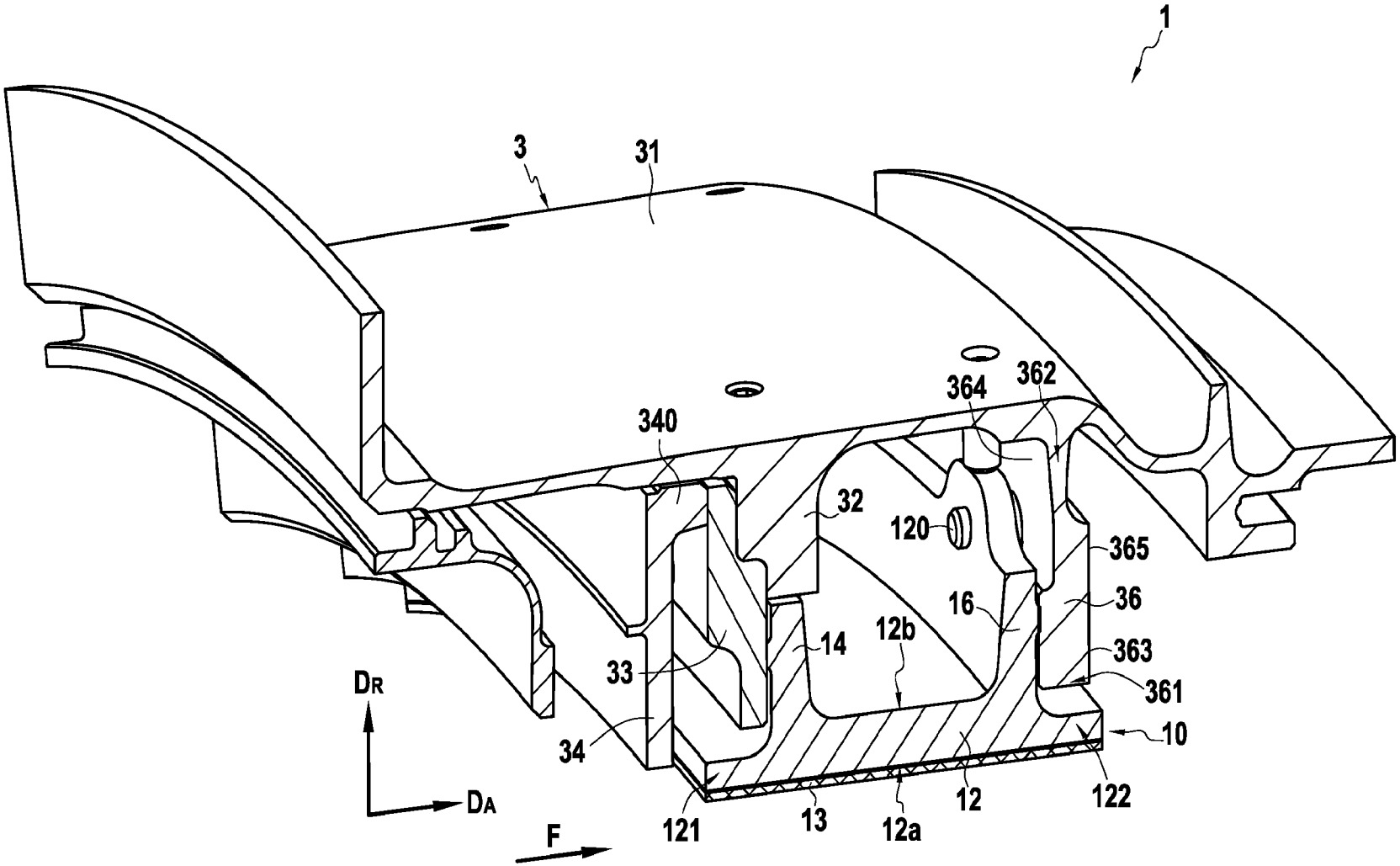
FIG. 1 is a schematic perspective view of a first embodiment of a turbine ring assembly according to the invention.

FIG. 1 shows a high-pressure turbine ring assembly comprising a turbine ring 1 made of ceramic-matrix composite material (CMC) and a metal ring support structure 3.

The turbine ring 1 surrounds an assembly of rotary blades (not represented). The turbine ring 1 is formed of a plurality of ring sectors 10, FIG. 1 being a radial sectional view. The arrow $D_A$ indicates the axial direction of the turbine ring 1 while the arrow $D_R$ indicates the radial direction of the turbine ring 1. For reasons of simplification of presentation, FIG. 1 is a partial view of the turbine ring 1 which is actually a complete ring.

Figure 2:
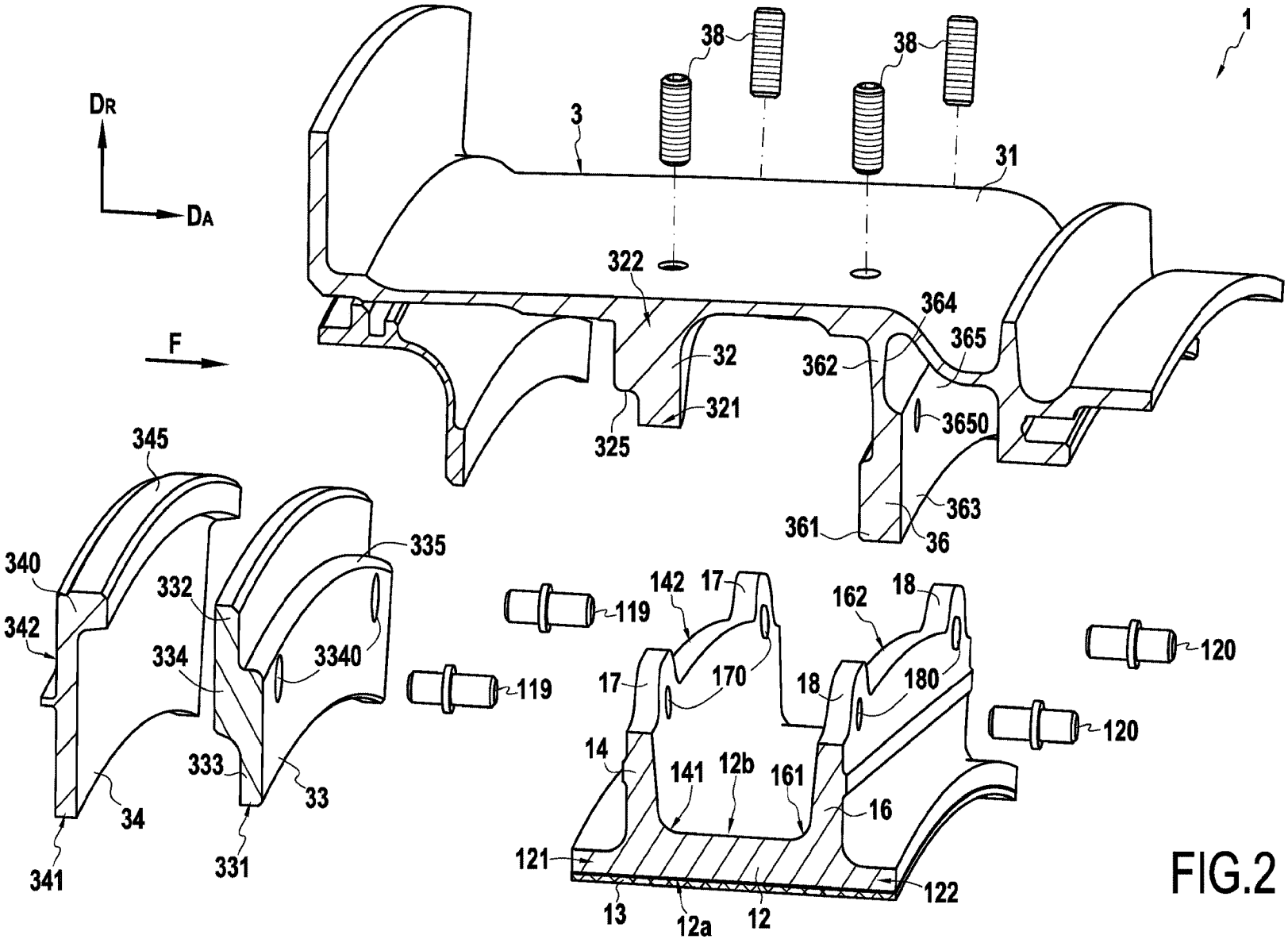
FIG. 2 is an exploded schematic perspective view of the turbine ring assembly of FIG. 1.
Figure 3:
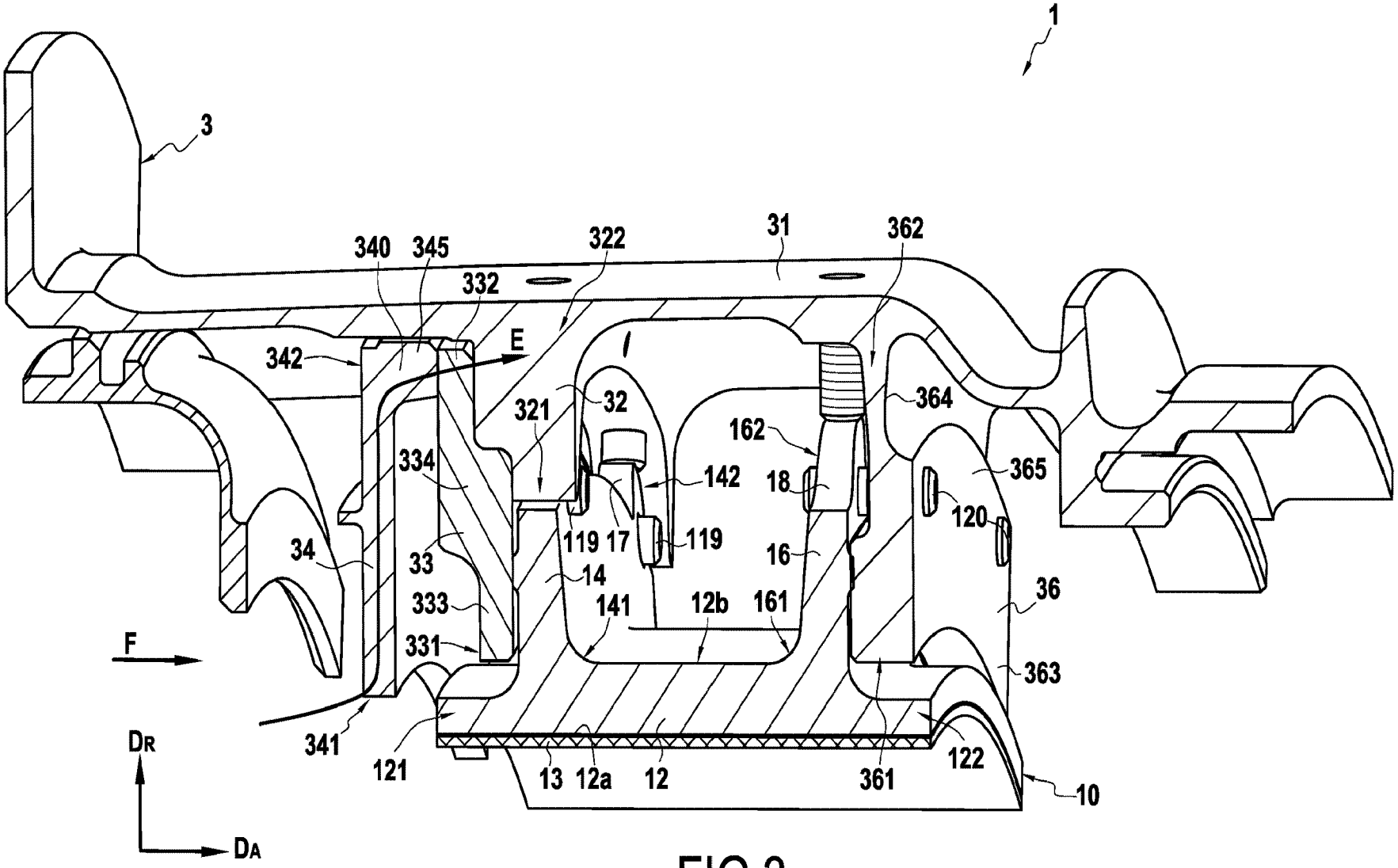
FIG. 3 is a schematic sectional view of the turbine ring assembly of FIG. 1.

As illustrated in FIGS. 2 and 3, which respectively have an exploded schematic perspective view and a sectional view of the turbine ring assembly of FIG. 1, the sectional view being along a section plane comprising the radial direction $D_R$ and the axial direction $D_A$, each ring sector 10 has, along a plane defined by the axial $D_A$ and radial $D_R$ directions, a section with substantially the shape of the inverted Greek letter (π). The section comprises indeed an annular base 12 and upstream and downstream radial attachment tabs, respectively 14 and 16. The terms "upstream" and "downstream" are used here with reference to the flowing direction of the gas flow in the turbine represented by the arrow F in FIG. 1. The tabs of the ring sector 10 could have another shape, the section of the ring sector having a shape other than π, such as a K- or an O-shape.

The annular base 12 includes, along the radial direction $D_R$ of the ring 1, an inner face 12*a* and an outer face 12*b* opposite to each other. The inner face 12*a* of the annular base 12 is coated with a layer 13 of abradable material forming a thermal and environmental barrier and defines a flow path of gas flow in the turbine. The terms "inner" and "outer" are used herein with reference to the radial direction $D_R$ in the turbine.

The upstream and downstream radial attachment tabs 14 and 16 protrude, along the direction $D_R$, from the outer face 12*b* of the annular base 12 away from the upstream and downstream ends 121 and 122 of the annular base 12. The upstream and downstream radial attachment tabs 14 and 16 extend over the entire width of the ring sector 10, that is to say, over the entire arc of circle described by the ring sector 10, or over the entire circumferential length of the ring sector 10.

As illustrated in FIGS. 1 to 3, the ring support structure 3 which is secured to a turbine casing comprises a central shroud 31, extending in the axial direction $D_A$, and having an axis of revolution coincident with the axis of revolution of the turbine ring 1 when they are fastened together, as well as a first radial annular clamp 32 and a second radial annular clamp 36, the first radial annular clamp 32 being positioned upstream of the second radial annular clamp 36 which is therefore downstream of the first radial annular clamp 32.

The second radial annular clamp 36 extends in the circumferential direction of the ring 1 and, along the radial direction $D_R$, from the central shroud 31 towards the center of the ring 1. It comprises a first free end 361 and a second end 362 secured to the central shroud 31. The second radial annular clamp 36 includes a first portion 363, a second portion 364, and a third portion 365 comprised between the first portion 363 and the second portion 364. The first portion 363 extends between the first end 361 and the third portion 365, and the second portion 364 extends between the third portion 365 and the second end 362. The first portion 363 of the second radial annular clamp 36 is in contact with the downstream radial attachment clamp 16. The second portion 364 is thinned relative to the first portion 363 and the third portion 365 so as to give some flexibility to the second radial annular clamp 36 and thus not to stress too much the CMC turbine ring 1.

The first radial annular clamp 32 extends in the circumferential direction of the ring 1 and, along the radial direction $D_R$, from the central shroud 31 to the center of the ring 1. It comprises a first free end 321 and a second end 322 secured to the central shroud 31.

As illustrated in FIGS. 1 to 3, the turbine ring assembly 1 comprises a first annular flange 33 and a second annular flange 34, the two annular flanges 33 and 34 being removably fastened to the first radial annular clamp 32. The first and second annular flanges 33 and 34 are disposed upstream of the turbine ring 1 with respect to the flowing direction F of the gas flow in the turbine.

The first annular flange 33 is disposed downstream of the second annular flange 34. The first annular flange 33 has a first free end 331 and a second end 332 removably fastened to the ring support structure 3, and more particularly to the first radial annular clamp 32. The second annular flange 34 has a first free end 341 and a second end 342 removably fastened to the ring support structure 3, and more particularly to the first radial annular clamp 32.

In addition, the first annular flange 33 has a first portion 333 extending from the first end 331 and a second portion 334 extending between the first portion 333 and the second end 332. When the ring assembly 1 is mounted, the first portion 333 of the first annular flange 33 bears against the upstream radial attachment tab 14 of each of the ring sectors 10 forming the turbine ring 1, and the second portion 334 of the first annular flange 33 bears against at least part of the first radial annular clamp 32.

The second annular flange 34 is dedicated to take up the force of the high-pressure distributor (DHP) on the ring assembly 1, on the one hand, by deforming and, on the other hand, by transiting this force towards the casing line which is more mechanically robust, that is to say toward the line of the ring support structure 3 as illustrated by the force arrows E represented in FIG. 3.

The first annular flange 33 and the second annular flange 34 are in contact at their second end respectively 332 and 342.

The radial holding of the ring 1 is ensured by the first annular flange 33 which is pressed on the first radial annular clamp 32 of the ring support structure 3 and on the upstream radial attachment tab 14. The first annular flange 33 ensures the sealing between the flowpath cavity and the off-flowpath cavity of the ring.

The second annular flange 34 ensures the connection between the downstream portion of the DHP, the ring support structure 3, or casing, by radial surface contact, and the first annular flange 33 by axial surface contact.

In the first embodiment illustrated in FIGS. 1 to 3, the second end 342 of the second annular flange 34 comprises a contact abutment 340 protruding in the axial direction $D_A$ between the second annular flange 34 and the first annular flange 33. The contact abutment 340 allows maintaining a distance between the first end 331 of the first annular flange 33 and the first end 341 of the second annular flange 34 during the tilting of the second annular flange 34 induced by the DHP force.

The first and second annular flanges 33 and 34 are fastened, by shrink-fitting, to the ring support structure 3.

The second annular flange 34 is shrink-fitted onto the central shroud 31 of the ring support structure 3, the shrink-fitting being carried out between a portion 345 protruding, in the radial direction $D_R$, from the second end 342 of the second annular flange 34 and the central shroud 31.

The first annular flange 33 is shrink-fitted onto the first radial annular clamp 32 of the ring support structure 3. More precisely, the shrink-fitting is carried out between a radial surface 335 approximately in the middle, in the radial direction $D_R$, of the first annular flange 33 and a radial surface 325 at mid-height of the first radial annular clamp 32, the two radial surfaces 335 and 325 facing each other, and even in contact with each other in the radial direction $D_R$. The radial surface 335 of the first annular flange 33 extends over the entire circumference of the first annular flange 33, and on the face of the first annular flange 33 facing the first annular clamp 32. More specifically, the radial surface 335 of the first annular flange 33 may be formed anywhere on the portion of the first annular flange 33 intended to be in contact with the first radial annular clamp 32, the radial surface 325 of the first radial annular clamp 32 being formed at a corresponding height on the face of the first radial annular clamp 32 facing the first annular flange 33.

The ring support structure 3 further comprises screws 38 which allow pressing the ring in a low radial position that is to say towards the flowpath, in a deterministic manner. There is indeed a clearance between the axial pins and the bores on the ring to compensate for the hot-operating differential expansion between the metal and the CMC elements.

Figure 4:
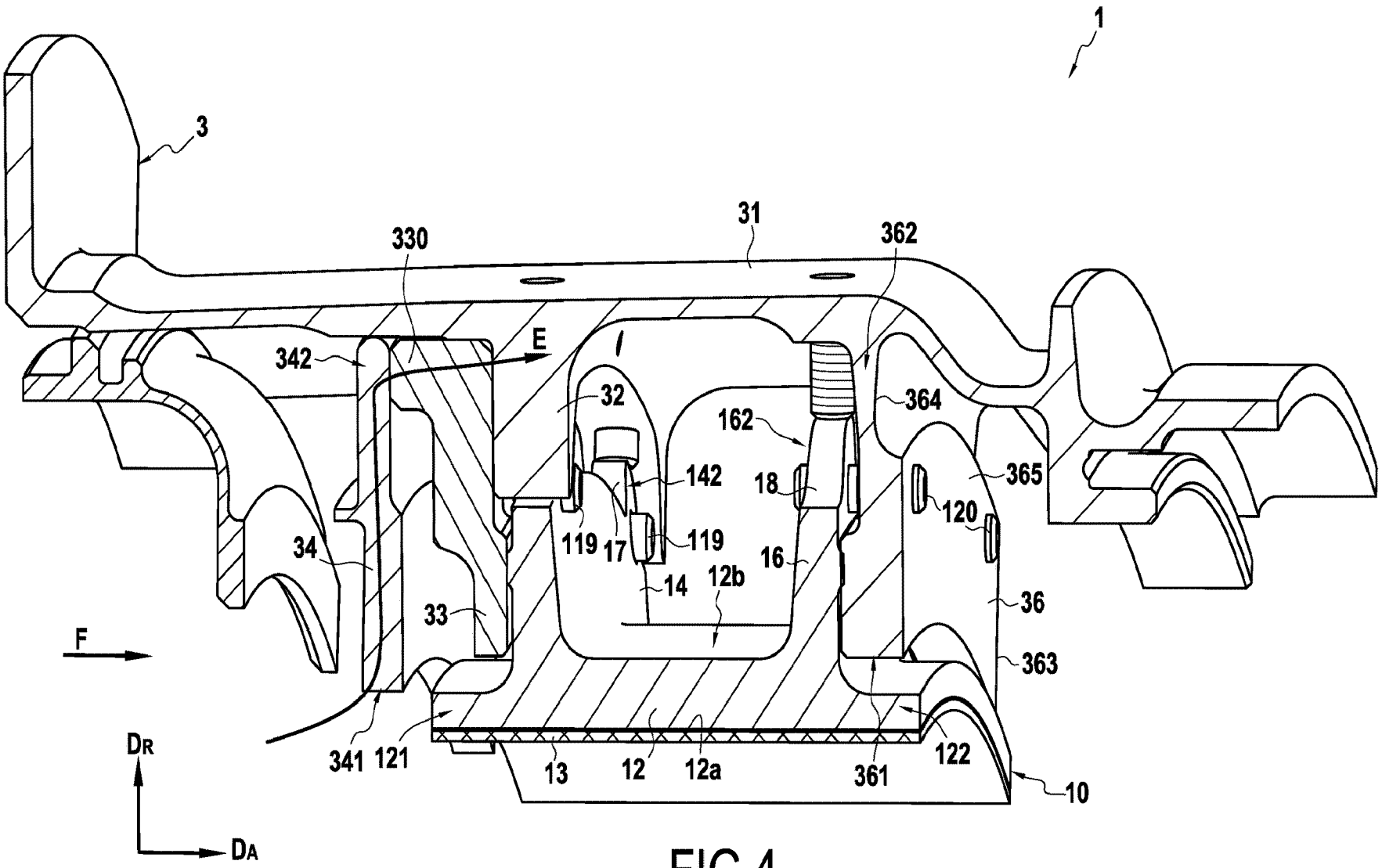
FIG. 4 is a schematic sectional view of a second embodiment of the turbine ring assembly.

FIG. 4 represents a schematic sectional view of a second embodiment of the turbine ring assembly.

The second embodiment of the invention illustrated in FIG. 4 differs from the first embodiment illustrated in FIGS. 1 to 3 mainly in that the second end 332 of the first annular flange 33 comprises a contact abutment 330, instead of the second flange 34, the contact abutment 330 protruding in the axial direction $D_A$ between the first annular flange 33 and the second annular flange 34.

As in the first embodiment, the first and second annular flanges 33 and 34 are fastened on the ring support structure 3 by radial shrink-fitting.

As illustrated in FIG. 4, in the second embodiment, the second end 342 of the second annular flange 34 has, in section along the section plane comprising the axial direction $D_A$ and the radial direction $D_R$, a rounded shape and thus forms a ball-joint in contact with the central shroud 31 of the ring support structure 3. The tilting of the second annular flange 34 occurs thanks to this ball-joint shape on the second end 342. The ball-joint is in linear contact with the central shroud 31 of the ring support structure 3. When the DHP force is applied to the second annular flange 34, the latter tilts forwards, that is to say in the flow F direction. The upper portion of the second annular flange 34 that is to say the one extending radially from the second end 342, is stopped axially by the contact abutment 330 of the first annular flange 33.

Figure 5:
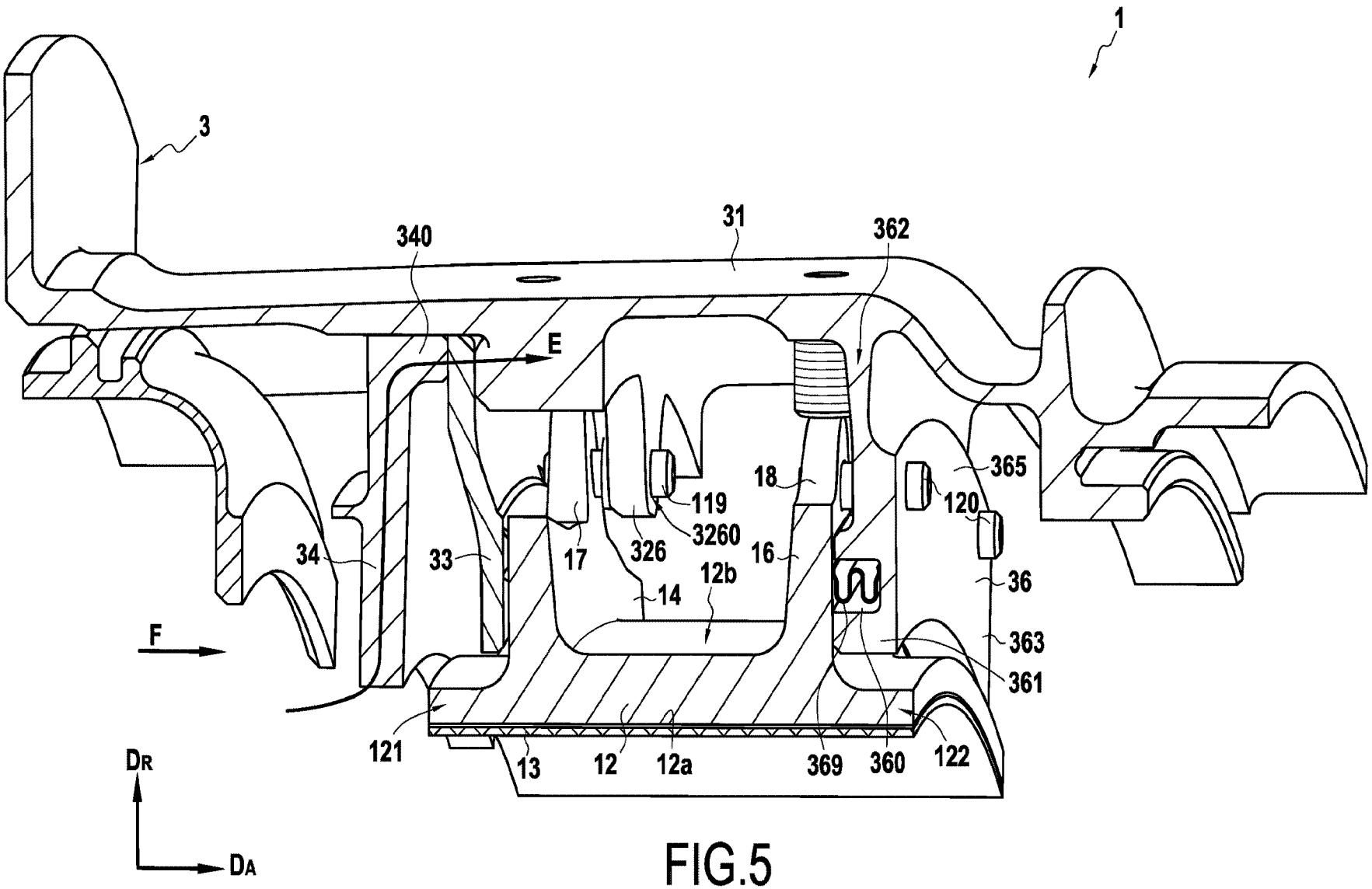
FIG. 5 is a schematic sectional view of a third embodiment of the turbine ring assembly.

FIG. 5 represents a schematic sectional view of a third embodiment of the turbine ring assembly.

The third embodiment of the invention illustrated in FIG. 5 also has the contact abutment 340 on the second end 342 of the second annular flange 34. The third embodiment differs from the first embodiment illustrated in FIGS. 1 to 3 mainly in that the first annular flange 33 has a thickness in the axial direction $D_A$ smaller than the thickness of the second annular flange 34. The first annular flange 33 is fastened by shrink-fitting of the second end 332 on the central shroud 31 of the ring support structure 3.

As explained further in the description, the third embodiment of the invention also has differences compared to the first embodiment for the fastening of the ring on the ring support structure 3.

In the third embodiment, the first portion of the second radial annular clamp 36 further comprises a groove 360 in which is disposed an omega seal 369 extending between the second radial annular clamp 36 and the downstream radial attachment tab 16.

Figure 6:
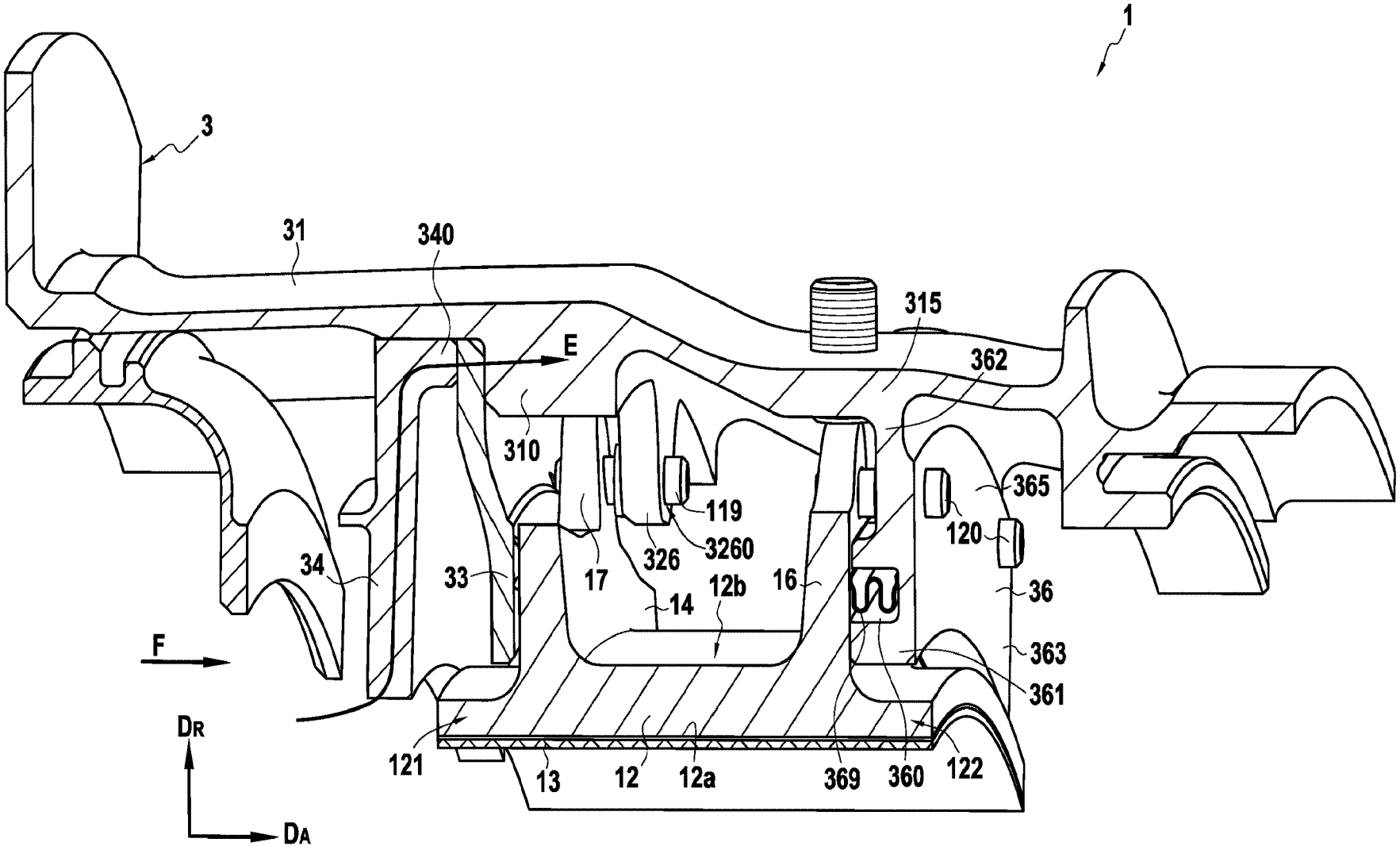
FIG. 6 is a schematic sectional view of a fourth embodiment of the turbine ring assembly.

FIG. 6 represents a schematic sectional view of a fourth embodiment of the turbine ring assembly.

The fourth embodiment of the invention illustrated in FIG. 6 is similar to the third embodiment illustrated in FIG. 5. The fourth embodiment also has the contact abutment 340 on the second end 342 of the second annular flange 34, the omega seal 369 extending in the groove 360 of the second radial annular clamp 36, as well as a thickness of the first annular flange 33 in the axial direction $D_A$ smaller than the thickness of the second annular flange 34.

The fourth embodiment of the invention illustrated in FIG. 6 differs from the third embodiment illustrated in FIG. 5 in that the central shroud 31 of the ring support structure 3 has a variable radius in the axial direction $D_A$, the radius of the central shroud 31 decreasing in the direction of the air flow F intended to pass through the turbine ring assembly, that is to say in the direction from the first radial clamp 32 to the second radial clamp 36.

The central shroud 31 of the ring support structure 3 has a first radial portion 310 facing the upstream radial attachment tab 14 of the ring 1, and a second radial portion 315 downstream of the first radial portion 310 relative to the direction of the air flow F and facing the downstream radial attachment tab 16 of the ring 1. The second radial portion 315 has a radius of curvature smaller than the radius of curvature of the first radial portion 310.

Figure 7:
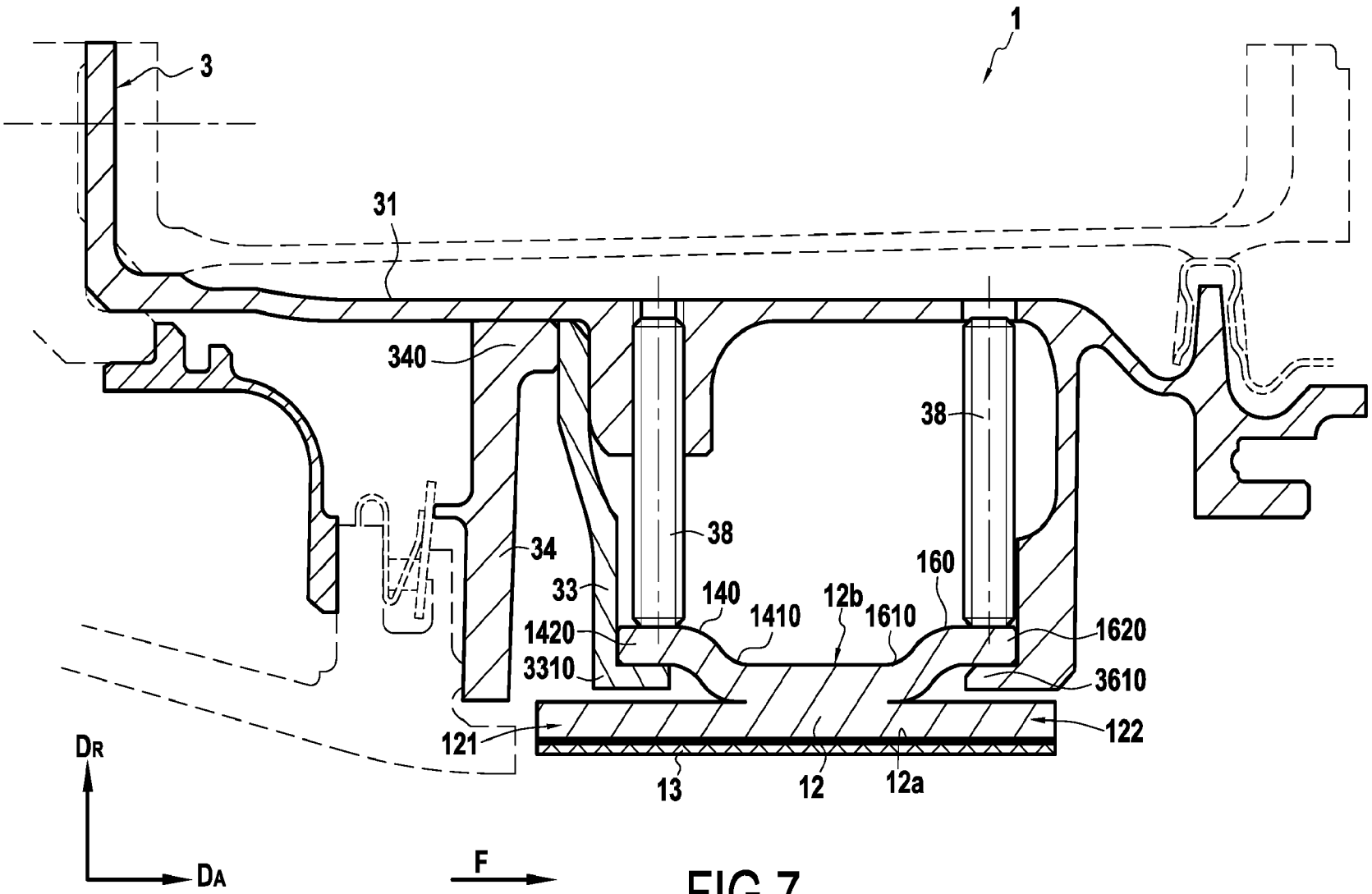
FIG. 7 is a schematic sectional view of a fifth embodiment of the turbine ring assembly.

FIG. 7 represents a schematic sectional view of a fifth embodiment of the turbine ring assembly.

The fifth embodiment illustrated in FIG. 7 differs from the first embodiment illustrated in FIGS. 1 to 3 in that the ring sector 10 has, in the plane defined by the axial $D_A$ and radial $D_R$ directions, a K-shaped section instead of an inverted π-shaped section.

Figure 8:
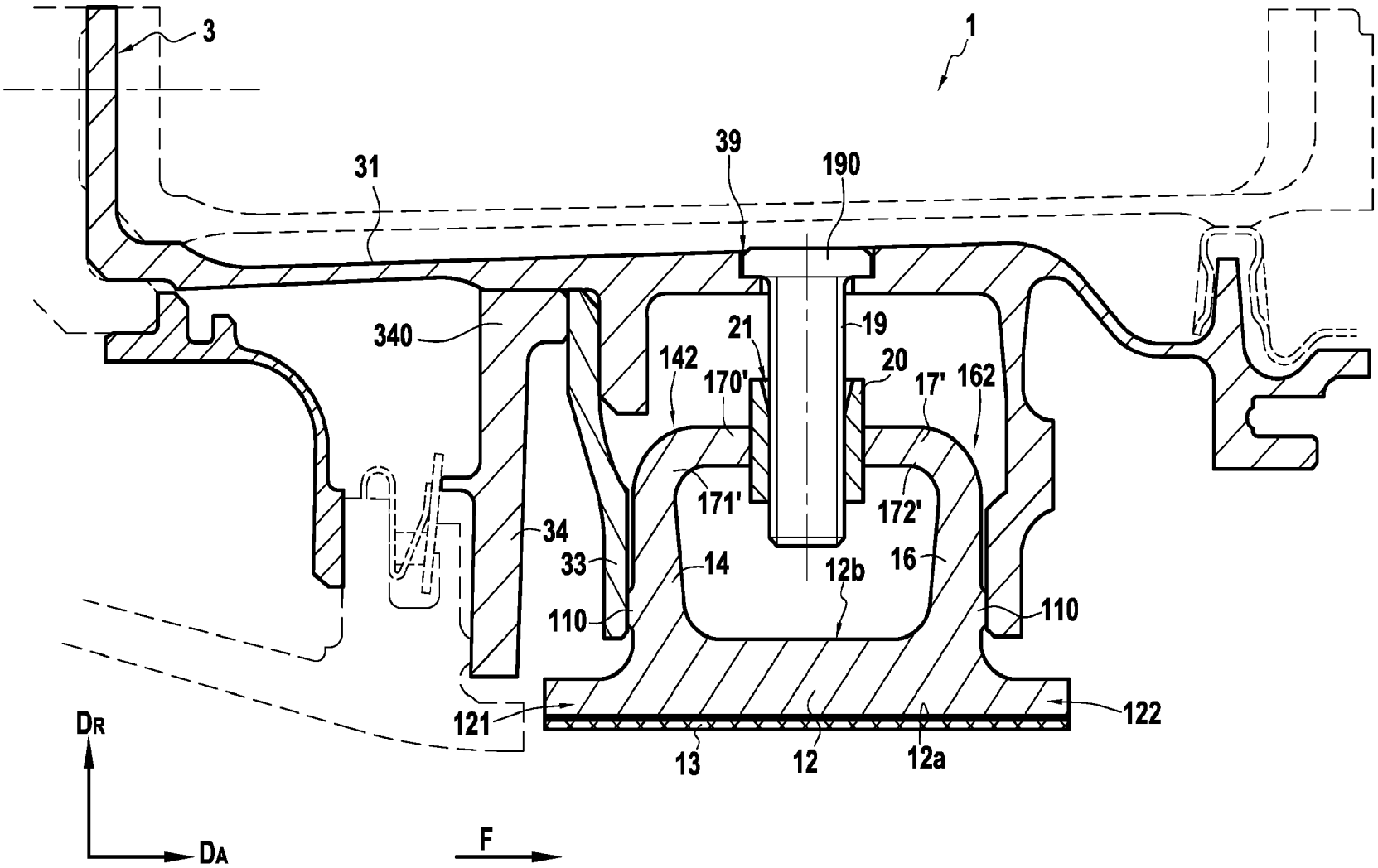
FIG. 8 shows a schematic sectional view of a sixth embodiment of the turbine ring assembly.

FIG. 8 represents a schematic sectional view of a sixth embodiment of the turbine ring assembly.

The sixth embodiment illustrated in FIG. 8 differs from the first embodiment illustrated in FIGS. 1 to 3 in that the ring sector 10 has, in the plane defined by the axial $D_A$ and radial $R_D$ directions, on a portion of the ring sector 10, an O-shaped section instead of an inverted π-shaped section, the ring section 10 being fastened to the ring support structure 3 by means of a screw 19 and a fastener 20, the screws 38 being removed.

In each of the embodiments of the invention illustrated in FIGS. 1 to 8, in the axial direction $D_A$, the second radial annular clamp 36 of the ring support structure 3 is separated from the first annular flange 33 by a distance corresponding to the spacing of the upstream and downstream radial attachment tabs 14 and 16 so as to maintain these between the first radial annular clamp 32 and the second radial annular clamp 36.

In the first and second embodiments illustrated in FIGS. 1 to 4, in order to hold the ring sectors 10, and therefore the turbine ring 1, in position, with the ring support structure 3, the ring assembly comprises two first pins 119 cooperating with the upstream attachment tab 14 and the first annular flange 33, and two second pins 120 cooperating with the downstream attachment tab 16 and the second radial annular clamp 36.

In these two embodiments illustrated respectively in FIGS. 1 to 3 and in FIG. 4, for each corresponding ring sector 10, the second portion 334 of the first annular flange 33 comprises two orifices 3340 for receiving the two first pins 119, and the third portion 365 of the radial annular clamp 36 comprises two orifices 3650 configured to receive the two second pins 120.

For each ring sector 10, each of the upstream and downstream radial attachment tabs 14 and 16 comprises a first end 141 and 161 secured to the outer face 12*b* of the annular base 12 and a second free end 142 and 162. The second end 142 of the upstream radial attachment tab 14 comprises two first lugs 17 each including an orifice 170 configured to receive a first pin 119. Similarly, the second end 162 of the downstream radial attachment tab 16 comprises two second lugs 18 each including an orifice 180 configured to receive a second pin 120. The first and second lugs 17 and 18 protrude in the radial direction $D_R$ of the turbine ring 1 respectively from the second end 142 of the upstream radial attachment tab 14 and the from second end 162 of the downstream radial attachment tab 16.

The orifices 170 and 180 may be circular or oblong. Preferably, all the orifices 170 and 180 comprise a portion of circular orifices and a portion of oblong orifices. The circular orifices make it possible to tangentially index the rings and to prevent them from moving tangentially (in particular in the event of contact by the vane). The oblong orifices allow accommodating the differential expansions between the CMC and the metal. The CMC has a coefficient of expansion much lower than that of the metal. At high temperature, the lengths in the tangential direction of the ring sector and of the casing portion vis-à-vis each other will therefore be different. If there were only circular orifices, the metal casing would impose its displacements to the CMC ring, which would be a source of very high mechanical stresses in the ring sector. Having oblong holes in the ring assembly allows the pin to slide into this hole and to avoid the overstress phenomenon mentioned above. Therefore, two drilling patterns can be imagined: a first drilling pattern, for a case with three lugs, would comprise a radial circular orifice on a radial attachment clamp and two tangential oblong orifices on the other radial attachment clamp, and a second drilling pattern, for a case with at least four lugs, would comprise a circular orifice and an oblong orifice by radial attachment clamp vis-à-vis each other each time. Other appended cases may be considered as well.

For each ring sector 10, the two first lugs 17 are positioned at two different angular positions with respect to the axis of revolution of the turbine ring 1. Likewise, for each ring sector 10, the two seconds lugs 18 are positioned at two different angular positions with respect to the axis of revolution of the turbine ring 1.

In the third and fourth embodiments illustrated in FIGS. 5 and 6, each ring sector comprises only one pin 119 cooperating with the upstream radial attachment tab 14 and with the first radial annular clamp 32. More particularly, the pin 119 cooperates with the orifice 170 of the first lug 17 of the corresponding upstream radial attachment tab 14 for the ring sector 10 and with an orifice 3260 of a lug 326 protruding radially towards the axis of revolution of the ring 1 and the ring support structure 3.

As illustrated in FIG. 7, in the fifth embodiment, each ring sector 10 has, along a plane defined by the axial $D_A$ and radial $D_R$ directions, a substantially K-shaped section comprising an annular base 12 with, along the radial direction $D_R$ of the ring, an inner face 12*a* coated with a layer 13 of abradable material forming a thermal and environmental barrier and which defines the flow path of gas flow in the turbine. Substantially S-shaped upstream and downstream radial attachment tabs 140, 160 extend, along the radial direction $D_R$, from the outer face 12*b* of the annular base 12 over the entire width thereof and above the upstream and downstream circumferential end portions 121 and 122 of the annular base 12.

The radial attachment tabs 140 and 160 have a first end, referenced respectively 1410 and 1610, secured to the annular base 12 and a second free end, referenced respectively 1420 and 1620. The free ends 1420 and 1620 of the upstream and downstream radial attachment tabs 140 and 160 extend either parallel to the plane in which the annular base 12 extends, that is to say along a circular plane, or rectilinearly while the attachment tabs 140 and 160 extend annularly. In this second configuration where the ends are rectilinear and the annular attachment tabs, in the case of a possible swing of the ring during the operation, the surface bearings then become linear bearings thereby providing a greater sealing than in the case of ad hoc bearings. The second end 1620 of the downstream radial attachment tab 160 is held between a portion 3610 of the second radial annular clamp 36 protruding in the axial direction $D_A$ from the first end 361 of the second radial annular clamp 36 in the opposite direction to the flow F direction and the free end of the associated screw 38, that is to say the screw opposite to the screw head. The second end 1410 of the upstream radial attachment tab 140 is held between a portion 3310 of the first annular flange 33 protruding in the axial direction $D_A$ from the first end 331 of the first annular flange 33 in the flow F direction and the free end of the associated screw 38.

In the sixth embodiment illustrated in FIG. 8, the ring sector 10 comprises an axial attachment tab 17' extending between the upstream and downstream radial attachment tabs 14 and 16. The axial attachment tab 17' extends more precisely, in the axial direction $D_A$, between the second end 142 of the upstream radial attachment tab 14 and the second end 162 of the downstream radial attachment tab 16.

The axial attachment tab 17' comprises an upstream end 171' and an end 172' separated by a central portion 170'. The upstream and downstream ends 171' and 172' of the axial attachment tab 17' protrude, in the radial direction $D_R$, from the second end 142, 162 of the radial attachment tab 14, 16 to which they are coupled, so as to have a central portion 170' of axial attachment tab 17' raised relative to the second ends 142 and 162 of the upstream and downstream radial attachment tabs 14 and 16.

For each ring sector 10, the turbine ring assembly comprises a screw 19 and a fastener 20. The fastener 20 is fastened on the axial attachment tab 17'.

The fastener 20 further comprises an orifice 21 equipped with a tapping cooperating with a thread of the screw 19 to fasten the fastener 20 to the screw 19. The screw 19 comprises a screw head 190 whose diameter is greater than the diameter of an orifice 39 made in the central shroud 31 of the support structure of the ring 3 through which the screw 19 is inserted before being screwed to the fastener 20.

The radial securing of the ring sector 10 with the ring support structure 3 is carried out using the screw 19, whose head 190 bears on the central crown 31 of the ring support structure 3, and the fastener 20 screwed to the screw 19 and fastened to the axial attachment tab 17' of the ring sector 10, the screw head 190 and the fastener 20 exerting forces of opposite directions in order to hold together the ring 1 and the ring support structure 3.

In a variant, the radial holding of the ring downwards can be ensured using four radial pins plated on the axial attachment tab 17', and the radial holding of the ring upwards can be ensured by a pickaxe head, secured to the screw 19, placed under the ring in the cavity between the axial attachment tab 17' and the outer face 12*b* of the annular base.

In each of the embodiments of the invention illustrated in FIGS. 1 to 8, each ring sector 10 further comprises rectilinear bearing surfaces 110 mounted on the faces of the upstream and downstream radial attachment tabs 14 and 16 in contact respectively with the first annular flange 33 and the second radial annular clamp 36, that is to say on the upstream face 14*a* of the upstream radial attachment tab 14 and on the downstream face 16*b* of the downstream radial attachment tab 16. In a variant, the rectilinear bearings could be mounted on the first annular flange 33 and on the second downstream radial annular clamp 36.

The rectilinear bearings 110 allow having controlled sealing areas. Indeed, the bearing surfaces 110 between the upstream radial attachment tab 14 and the first annular flange 33 on the one hand, and between the downstream radial attachment tab 16 and the second radial annular clamp 36 on the other hand, are comprised in the same rectilinear plane.

More precisely, having bearings on radial planes allows overcoming the effects of de-cambering in the turbine ring 1.

A method for producing a turbine ring assembly corresponding to that represented in FIG. 1, that is to say according to the first embodiment illustrated in FIGS. 1 to 3, is now described.

Each ring sector 10 described above is made of ceramic-matrix composite material (CMC) by formation of a fibrous preform having a shape close to that of the ring sector and densification of the ring sector by a ceramic matrix.

For the production of the fibrous preform, it is possible to use ceramic fiber yarns, for example SiC fiber yarns, such as those marketed by the Japanese company Nippon Carbon under the name "Hi-NicalonS", or carbon fiber yarns.

The fibrous preform is advantageously made by three-dimensional weaving, or multilayer weaving with arrangement of debonding areas allowing the portions of preforms corresponding to the attachment tabs 14 and 16 of the sectors 10 to be spaced apart.

The weaving can be of the interlock type, as illustrated. Other weaves of three-dimensional or multilayer weaving can be used such as for example multi-plain or multi-satin weaves. Reference can be made to document WO 2006/136755.

After weaving, the blank can be shaped to obtain a ring sector preform which is consolidated and densified by a ceramic matrix, the densification can be achieved in particular by gas-phase chemical infiltration (CVI) which is well known per se. In a variant, the textile preform can be a little cured by CVI so that it is rigid enough to be manipulated, before raising liquid silicon by capillarity in the textile for carrying out the densification ("Melt Infiltration").

A detailed example of manufacture of CMC ring sectors is in particular described in document US 2012/0027572.

The ring support structure 3 is for its part made of a metal material such as a Waspaloy® or inconel 718® or C263® alloy.

The production of the turbine ring assembly is continued by the mounting of the ring sectors 10 on the ring support structure 3.

For this, the ring sectors 10 are assembled together on an annular tool of the "spider" type including, for example, suckers configured to each hold a ring sector 10.

Then, the two second pins 120 are inserted into the two orifices 3650 provided in the third portion 365 of the second radial annular clamp 36 of the ring support structure 3.

The ring 1 is then mounted on the ring support structure 3 by inserting each second pin 120 into each of the orifices 180 of the second lugs 18 of the downstream radial attachment clamps 16 of each ring sector 10 forming the ring 1.

All the first pins 119 are then placed in the orifices 170 provided in the first lugs 17 of the radial attachment tab 14 of the ring 1.

Then, the first annular flange 33 and the second annular flange 34 are fastened to the ring support structure 3 and to the ring 1. The first and second annular flanges 33 and 34 are fastened by shrink-fitting to the ring support structure 3. The DHP force exerted in the direction of the flow F reinforces this fastening during the operation of the engine.

In order to radially hold the ring 1 in position, the first annular flange 33 is fastened to the ring by inserting each first pin 119 into each of the orifices 170 of the first lugs 17 of the upstream radial attachment tabs 14 of each ring sector 10 forming the ring 1.

The ring 1 is thus axially held in position using the first annular flange 33 and the second radial annular clamp 36 bearing respectively upstream and downstream on the rectilinear bearing surfaces 110 of the respectively upstream 14 and downstream 16 radial attachment tabs. During the installation of the first annular flange 33, an axial prestressing may be applied to the first annular flange 33 and to the upstream radial attachment tab 14 to overcome the effect of differential expansion between the CMC material of the ring 1 and the metal of the ring support structure 3. The first annular flange 33 is maintained in axial stress by mechanical elements placed upstream as illustrated in dashed lines in FIG. 3.

The ring 1 is radially held in position using the first and second pins 119 and 120 cooperating with the first and second lugs 17 and 18 and the orifices 3340 and 3650 of the first annular flange 33 and the radial annular clamp 36.

The invention thus provides a turbine ring assembly allowing to maintain each ring sector in a deterministic manner while allowing, on the one hand, the ring sector, and by extension the ring, to deform under the effects of temperature rises and pressure variations, and in particular independently of the interface metal parts and, on the other hand, while improving the sealing between the off-flowpath sector and the flowpath sector and while simplifying manipulations and reducing their number for the mounting of the ring assembly.

In addition, the invention provides a turbine ring assembly comprising an upstream annular flange dedicated to take up the DHP force and thus to induce low levels of forces in the CMC ring, a contact abutment between the annular flange dedicated to take up the DHP force and the annular flange used to maintain the ring, the abutment allowing to ensure the non-contact of the low portions of the two flanges upon tilting of the upstream flange. The turbine ring assembly according to the invention also allows controlling the rigidity at the upstream and downstream axial contacts between the CMC ring and the metal casing. As a result, the sealing is ensured in all circumstances without inducing too high axial forces on the ring.

The invention claimed is:

1. A turbine ring assembly comprising:

a plurality of ring sectors forming a turbine ring, each ring sector being made of ceramic-matrix composite material and having, along a section plane defined by an axial direction and a radial direction of the turbine ring, a portion forming an annular base with, in the radial direction of the turbine ring, an inner face defining the inner face of the turbine ring and an outer face from which a first attachment tab and a second attachment tab protrude;

a ring support structure, the ring support structure being made of metal and including a central shroud from which a first radial clamp and a second radial clamp protrude between which the first attachment tab and the second attachment tab of each ring sector are maintained;

a first annular flange; and a second annular flange disposed upstream of the first annular flange with respect to a direction of an air flow intended to pass through the turbine ring assembly, wherein the first and second annular flanges each respectively have a first free radial end and a second radial end opposite to the first free radial end, the first free radial end of the first flange bearing axially against the first attachment tab, the first free radial end of the second annular flange being distant from the first free radial end of the first annular flange in the axial direction, wherein the second radial ends of the first annular flange and second annular flange are removably fastened to the first radial clamp of the central shroud of the ring support structure such that the second radial end of the first annular flange is sandwiched between the first radial clamp of the central shroud of the ring support structure and the second radial end of the second annular flange, wherein the first annular flange and the second annular flange are shrink-fitted to the ring support structure, the second radial end of the second annular flange abutting an inner surface of the central shroud of the ring support structure in the radial direction, and a portion of the first annular flange abutting the ring support structure in the radial direction, and wherein one of the second radial end of the first annular flange and the second radial end of the second annular flange presents a contact abutment protruding in the axial direction and abutting axially the other of the second radial end of the first annular flange and the second radial end of the second annular flange.

2. The assembly according to claim 1, wherein the first annular flange comprises the contact abutment.

3. The assembly according to claim 1, wherein the second annular flange comprises the contact abutment.

4. The assembly according to claim 1, wherein the first flange has a thickness in the axial direction smaller than the thickness in the axial direction of the second flange.

5. The assembly according to claim 4, wherein the central shroud of the ring support structure has a variable radius in the axial direction, the radius of the central shroud decreasing along the direction of the air flow intended to pass through the turbine ring assembly.

6. The assembly according to claim 4, wherein the second radial clamp of the ring support structure has a first free radial end and a second radial end secured to the central shroud of the ring support structure, the first free radial end of the second radial clamp being in contact with the second attachment tab of the turbine ring and having a thickness in the axial direction greater than the thickness of the first end of the first annular flange.

7. The assembly according to claim 1, wherein the ring sector has W inverted π-shaped section along the section plane defined by the axial direction and the radial direction, wherein the assembly comprises, for each ring sector, at least three pins to radially hold the ring sector in position, and wherein the first attachment tab and the second attachment tab of each ring sector each comprises a first radial end secured to the outer face of the annular base, a second free radial end, and at least three lugs for receiving said at least three pins, at least two lugs of said at least three lugs protruding from the second radial end of one of the first attachment tab or the second attachment tab in the radial direction of the turbine ring and at least one lug of said at least three lugs protruding from the second radial end of the other of the first attachment tab and the second attachment tab in the radial direction of the turbine ring, each of said at least three lugs including an orifice for receiving one of the pins.

8. The assembly according to claim 1, wherein the ring sector has a K-section along the section plane defined by the axial direction and the radial direction, the first attachment tab and the second attachment tab having an S-shape.

9. The assembly according to claim 1, wherein the ring sector has an O-shaped section along the section plane defined by the axial direction and the radial direction, the first attachment tab and the second attachment tab each having a first end secured to the outer face and a second free end, and wherein each ring sector comprises a third attachment tab and a fourth attachment tab each extending, in the axial direction of the turbine ring, between a second radial end of the first attachment tab and a second radial end of the second attachment tab, each ring sector being fastened to the ring support structure by a fastening screw including a screw head bearing against the ring support structure and a thread cooperating with a tapping formed in a fastening plate, the fastening plate cooperating with the third attachment tab and the fourth attachment tab.

10. A turbomachine comprising a turbine ring assembly according to claim 1.

* * * * *